US011390419B2

(12) United States Patent
Martin

(10) Patent No.: US 11,390,419 B2
(45) Date of Patent: Jul. 19, 2022

(54) PACKAGE ASSEMBLY

(71) Applicant: LIBERTY HARDWARE MFG. CORP., Winston-Salem, NC (US)

(72) Inventor: Ryan Martin, Kernersville, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 16/931,722

(22) Filed: Jul. 17, 2020

(65) Prior Publication Data

US 2021/0016917 A1 Jan. 21, 2021

Related U.S. Application Data

(60) Provisional application No. 62/875,740, filed on Jul. 18, 2019.

(51) Int. Cl.
*B65D 5/42* (2006.01)
*B65D 5/02* (2006.01)

(52) U.S. Cl.
CPC ..... *B65D 5/4208* (2013.01); *B65D 5/0254* (2013.01)

(58) Field of Classification Search
CPC ..... B65D 5/4208; B65D 5/46088; B65D 5/4612; B65D 5/46125; B65D 5/46184
USPC ..... 229/117.18, 117.09, 117.24, 117.14, 229/117.15; 493/909; 206/803
See application file for complete search history.

(56) References Cited

U.S. PATENT DOCUMENTS 1,877,601 A * 9/1932 Shapiro ..... B65D 5/46032 229/117.15
2,168,387 A * 8/1939 Bellin ..... B65D 5/46152 229/117.15
2,663,485 A * 12/1953 Johnson ..... B65D 5/4612 229/117.15
2,695,128 A * 11/1954 Rendall ..... B65D 5/46152 229/117.13
2,789,750 A * 4/1957 Kramer ..... B65D 5/302 229/149

(Continued)

FOREIGN PATENT DOCUMENTS

WO 2012068011 A2 5/2012

OTHER PUBLICATIONS

Liberty Hardware Mfg. Corp., Cabinet Hardware Box, Applicant Admitted Prior Art, 3 pages, US.

*Primary Examiner* — Nathan J Newhouse
*Assistant Examiner* — Phillip D Schmidt
(74) *Attorney, Agent, or Firm* — Brooks Kushman PC; Lora Graentzdoerffer

(57) ABSTRACT

A package assembly is provided with a plurality of pivotally connected panels to collectively at least partially enclose a product. At least one hang tab is pivotally connected to a minor panel of the plurality of pivotally connected panels, to extend through a slot in one of the plurality of pivotally connected panels to support the package assembly at retail. A method of assembling a package assembly provides the plurality of pivotally connected panels to collectively at least partially enclose and package the product. At least one hang tab is provided on a minor panel spaced from a pivotal connection of the minor panel to extend within the package. The minor panel is folded into the package. The at least one hang tab is inserted into a slot in one of the plurality of pivotally connected panels.

18 Claims, 7 Drawing Sheets

(56) References Cited

U.S. PATENT DOCUMENTS

| | | | | |
|---|---|---|---|---|
| 3,182,913 | A * | 5/1965 | Brian | B65D 5/247<br>229/117.13 |
| 3,777,883 | A * | 12/1973 | Hackenberg | B65D 5/5019<br>206/780 |
| 4,279,376 | A | 7/1981 | Roccaforte | |
| 4,291,807 | A | 9/1981 | Giordano et al. | |
| 6,145,659 | A | 11/2000 | Faircloth et al. | |
| 6,305,597 | B1 | 10/2001 | Donegan et al. | |
| 6,375,010 | B1 | 4/2002 | Thibault | |
| 2011/0297738 | A1* | 12/2011 | Hsiao | B65D 5/4208<br>229/117.09 |
| 2013/0277272 | A1* | 10/2013 | Oja | B65D 5/566<br>206/775 |
| 2016/0207680 | A1* | 7/2016 | Streich | B65D 5/0254 |

* cited by examiner

PACKAGE ASSEMBLY

CROSS-REFERENCE TO RELATED APPLICATIONS

This application claims the benefit of U.S. provisional application Ser. No. 62/875,740 filed Jul. 18, 2019, the disclosure of which is hereby incorporated in its entirety by reference herein.

TECHNICAL FIELD

Various embodiments relate to package assemblies for consumer products.

BACKGROUND

Conventional package assemblies of consumer products often include separate hang tabs to hang the package assembly from pegs for retail at a point-of-sale display. The hang tabs are often formed from a separate polymeric material and are fastened to the package assembly with an adhesive.

SUMMARY

According to an embodiment, a package assembly is provided with a plurality of pivotally connected panels to collectively at least partially enclose a product. At least one hang tab is pivotally connected to a minor panel of the plurality of pivotally connected panels, to extend through a slot in one of the plurality of pivotally connected panels to support the package assembly at retail.

According to a further embodiment, the at least one hang tab is centered on the package assembly to lie in a plane with a center of gravity of the package assembly and the at least partially enclosed product.

According to another further embodiment, the plurality of pivotally connected panels provide a front panel, a top panel, a rear panel, and a bottom panel. The minor panel is pivotally connected to one of the front panel, the top panel, the rear panel, and the bottom panel.

According to an even further embodiment, the minor panel is pivotally connected to the top panel.

According to another further embodiment, the minor panel is a first minor panel pivotally connected to the top panel at a fold line. The package assembly is further provided with a second minor panel pivotally connected to the top panel at the same fold line as the first minor panel, with a cut line separating the first minor panel and the second minor panel.

According to another further embodiment, the slot is formed through the top panel for the at least one hang tab to extend through the top panel.

According to an even further embodiment, a flange is pivotally connected to the at least one hang tab to extend into the package assembly and retain the at least one hang tab within the slot.

According to another even further embodiment, the plurality of pivotally connected panels is further provided with a pair of major end panels, each pivotally connected to a lateral end of one of the front panel, the top panel, the rear panel, and the bottom panel.

According to another even further embodiment, the pair of major end panels conceals the minor panel within the package assembly.

According to another further embodiment, the minor panel covers a seam along one of the pair of major end panels.

According to another further embodiment, the at least one hang tab is further provided with a pair of hang tab panels.

According to another further embodiment, the package assembly is formed from a unitary sheet of material, and the at least one hang tab is positioned laterally within an overall rectilinear area of the package assembly when flat to avoid an increase to an overall size of the sheet of material.

According to another further embodiment, the at least one hang tab is further provided with a first hang tab panel pivotally connected to the minor panel. A slot is formed at a fold line of the first hang tab panel and the minor panel. A second hang tab panel is pivotally connected to the first hang tab panel. A locking tab extends from the second hang tab panel to lock within the slot at the fold line of the first hang tab panel and the minor panel.

According to another further embodiment, the at least one hang tab has a width greater than a width of the slot to provide an interference fit within the slot.

According to another further embodiment, the at least one hang tab is provided with a slot to receive a peg at a point-of-sale display.

According to another further embodiment, polymers and adhesives are omitted from the package assembly.

According to another embodiment, a package assembly is provided with a unitary sheet of material defining a plurality of panels to collectively at least partially enclose a product, and at least one hang tab, to extend through at least one slot in at least one of the plurality of panels to support the package assembly at retail.

According to another embodiment, a method of arranging a hang tab on a package assembly, provides a plurality of pivotally connected panels to collectively at least partially enclose and package a consumer product. A hang tab location is determined to support the package assembly. At least one hang tab is provided on a minor panel spaced from a pivotal connection of the minor panel to extend within the package to the determined hang tab location.

According to another embodiment, a method of assembling a package assembly provides a plurality of pivotally connected panels to collectively at least partially enclose and package a consumer product. At least one hang tab is provided on a minor panel spaced from a pivotal connection of the minor panel to extend within the package. The minor panel is folded into the package. The at least one hang tab is inserted into a slot in one of the plurality of pivotally connected panels.

According to a further embodiment, the at least one hang tab is pushed partially into the slot for compactness during transit.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional package assemblies of consumer products often include separate hang tabs to hang the package assembly from pegs for retail at a point-of-sale display. The hang tabs are often formed from a separate polymeric material and are fastened to the package assembly with an adhesive. The separate hang tabs are often fastened to a rear surface of the package assembly causing the package assembly to pivot below the hang tab such that a forward surface of the package assembly is tilted downward. Additionally, the tilting of the package assembly may apply loading to the adhesive in a peel direction, instead of shear, which may cause the adhesive to fail. The separate polymeric hang tab and adhesive add material cost and manufacturing steps to the package assembly.

Package assemblies are often discarded soon after purchase of the consumer product. Use of polymeric hang tabs and adhesives reduce the sustainability and recyclability of the package assembly.

Figure 1:
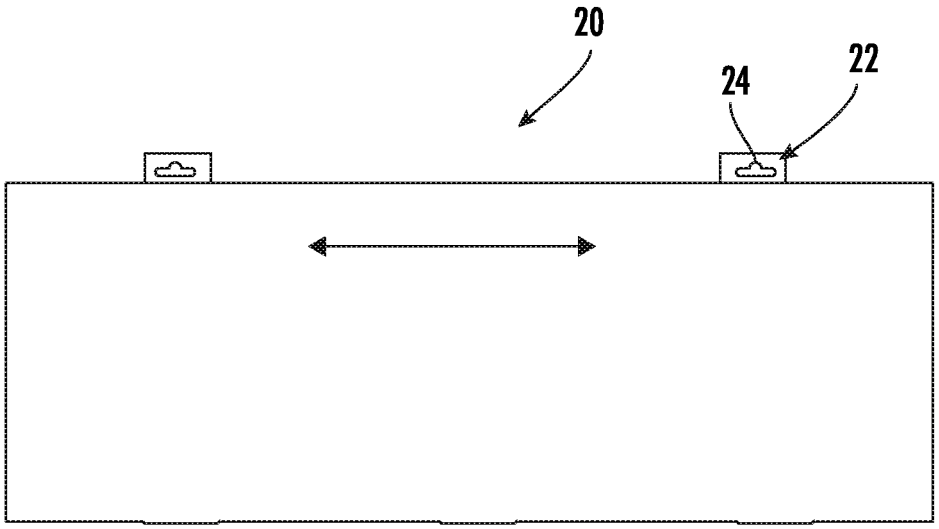
FIG. 1 is a front perspective view of a package assembly according to an embodiment.
Figure 2:
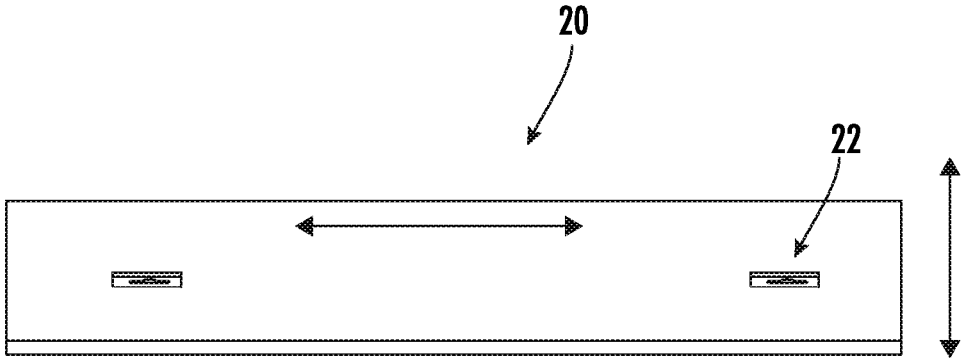
FIG. 2 is a top perspective view of the package assembly of FIG. 1.

FIGS. 1 and 2 illustrate a package assembly 20 for a consumer product, according to an embodiment. Consumer products that are packaged and retailed in package assemblies 20 with hang tabs include home and bath hardware, such as towel bars, glass shelves, periodical racks, tray racks, towel racks, hook racks, any consumer products that may be partially or fully enclosed and supported within a box, and the like. The package assembly 20 includes hang tabs 22 that are incorporated into flaps within the package assembly 20. Although a pair of hang tabs 22 are illustrated, any number and orientation of hang tabs 22 may be employed, depending upon the size, orientation, and loading of the package assembly 20. For example, one central hang tab 22 may be employed.

The package assembly 20 is a closed box to be hung by the hang tabs 22 when merchandised. The hang tabs 22 each include a slot 24 to receive a peg of a pegboard, as is known in the art. The package assembly 20 and the hang tabs 22 are designed to support a weight of the product while omitting polymers and adhesives from the package assembly 20. By integrating the hang tabs 22 into the package assembly 20, the hang tabs 22 are centered in a depth orientation on the package assembly 20 (front to back or vertically in FIG. 2) so that the hang tabs 22 generally lie in a plane with a center of gravity of the package assembly 20 and the packaged consumer product so that the package assembly 20 hangs straight without a tilt. Although the depicted embodiment omits polymers and adhesives, various embodiments may employ the hang tabs 22 in combination with conventional polymeric hang tabs and adhesives, whereby the hang tabs 22 reduce the quantity of separate components.

Figure 3:
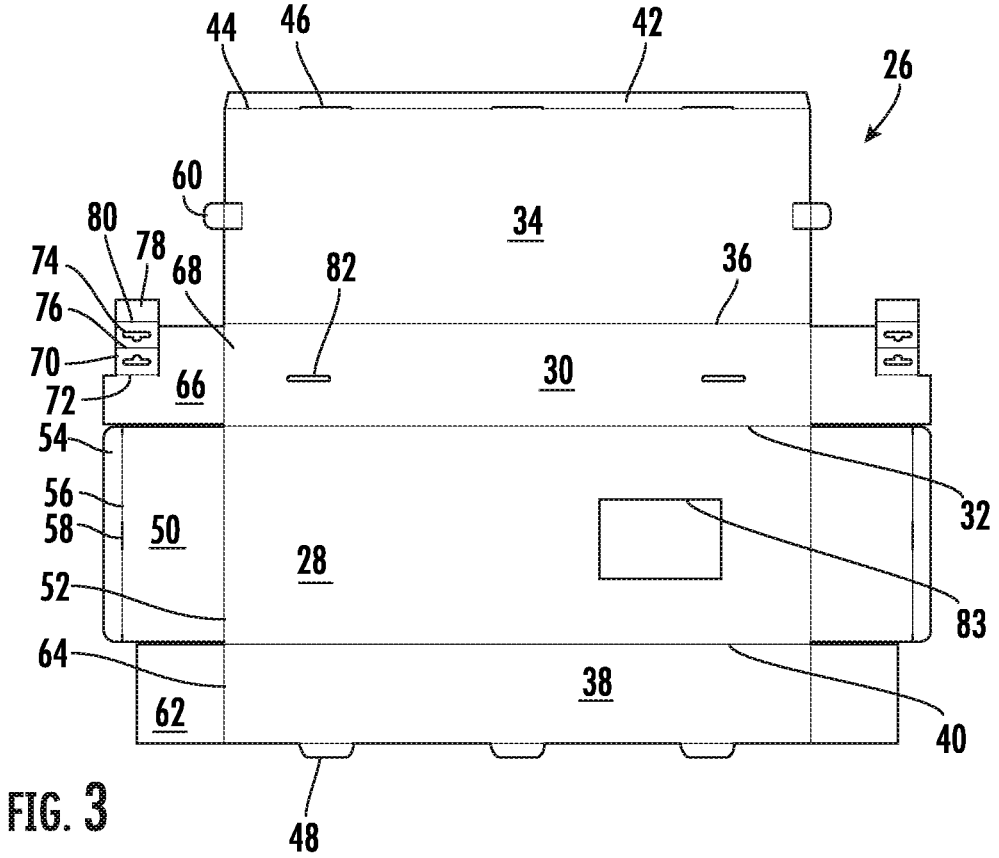
FIG. 3 is a plan view of a blank of the package assembly of FIG. 1, according to an embodiment.

Referring now to FIG. 3, a blank 26 for the package assembly 20 is illustrated according to an embodiment. The blank 26 may be formed from cardboard, corrugated material, or any suitable packaging material. The blank 26 is a single component or sheet of material and provides all of the features of the package assembly 20. The blank includes a front panel 28 with a height and length to house the consumer product. A top panel 30 is pivotally connected to the front panel 28 at fold line 32. The top panel 30 has a depth and a length to house the consumer product. A rear panel 34 is about the same size as the front panel 28 and is pivotally connected to the top panel 30 at fold line 36.

A bottom panel 38 is pivotally connected to the front panel 28 at fold line 40. For the present embodiment, the bottom panel 38 also has similar dimensions to the top panel 30. Alternatively, irregular box shapes may also be employed. An assembly flap 42 is provided along the rear panel 34 along fold line 44. A plurality of slots 46 are formed through the flap-rear fold line 44. During assembly, the front panel 28, top panel 30, rear panel 34, bottom panel 38, and assembly flap 42 are folded along the fold lines 32, 36, 40, 44 so that the assembly flap 42 is received behind the bottom panel 38. A plurality of locking tabs 48 are formed along the bottom panel 38 to extend through the slots 46 and to fasten the bottom panel 38 and the rear panel 34. Alternatively, the package assembly 20 may be partially or fully enclosed and sealed with an adhesive joint or tape, staples, or any suitable fastener.

A pair of major end panels or major flaps 50 are pivotally connected to the front panel 28 at fold lines 52. The major flaps 50 have a height and a depth according to the height and depth of the package assembly 20. An assembly flap 54 is pivotally connected to each major flap 50 at fold line 56. A slot 58 is formed in each fold line 56. During assembly, the assembly flap 54 is folded into the package assembly 20 in front of the rear panel 34. A pair of assembly tabs 60 are provided along the rear panel 34 to extend into the slots 58 and assemble the major flap 50 to the rear panel 34.

A pair of minor end panels or minor flaps 62 are each pivotally connected to the bottom panel 38 at fold lines 64. The minor flaps 62 are folded into the package assembly prior to closing the ends with the major flaps 50. The minor flaps 62 cover a seam along the major flaps 50 and act as dust flap to minimize dust that enters the seam. Additionally, the minor flaps 62 assist to retain and support the major flaps 50.

Another pair of minor flaps 66 are pivotally connected to the top panel 30 along fold lines 68. The hang tabs 22 each include a hang tab panel 70 pivotally connected to the top minor flaps 66 at fold line 72. The hang tabs 22 may include a single panel 70. Depending on loading requirements of the package assembly 20, an additional hang tab panel 74 may be connected to the first hang tab panel 70 at fold line 76 to double the thickness and enhance the structure support of the hang tabs 22. Additionally flanges 78 may be pivotally connected to the second hang tab panels 74 at fold line 80 for alignment of the hang tabs 22. If only a single panel 70 is employed, then the flanges 78 could each be connected to the single panel 70. For example, a right angle cut may be provided off of fold line 72 to create a flange for the single panel 70. The flanges 78 are illustrated with a width generally corresponding to a width of the hang tab panels 70, 74. However, the flanges 78 may have any suitable width, such as greater or less than a width of the hang tab panels 70, 74.

Figure 4:
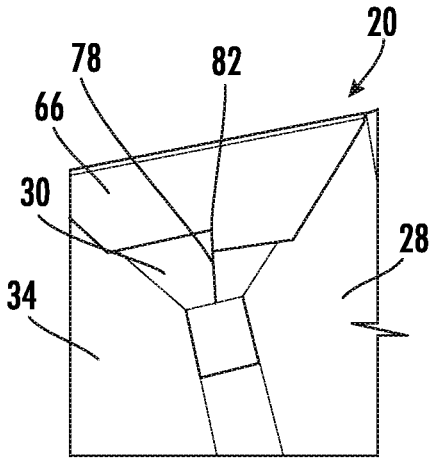
FIG. 4 is a side end perspective view of the package assembly of FIG. 3.
Figure 5:
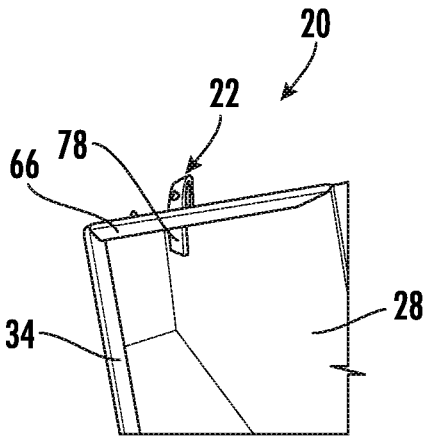
FIG. 5 is another side end perspective view of the package assembly of FIG. 3.

A pair of slots 82 are formed through the top panel 30. The slots 82 are each sized to permit one of the hang tabs 22 to pass through to extend out of the package assembly 20 if required to hang the package assembly 20 upon a display peg. Referring now to FIGS. 4 and 5, the upper minor flap 66 is illustrated folded into the package assembly 20, along the top panel 30 and between the front panel 28 and the rear panel 34. The hang tab 22 is aligned with the slot 82 to extend out through the slot 82 and out of the top panel 30. The hang tab flange 78 extends into the package assembly 20 to maintain the second hang tab panel 74 in alignment with the slot 82 and to avoid pulling the second hang tab panel 74 through the slot 82.

The sizing of the slots 82 relative to the hang tabs 22 may permit the hang tabs 22 to be pushed partially into the slots 82 for compactness during transit. The packaged product and the package assembly 20 may cooperate so that the packaged product prevents the hang tabs 22 from being overly depressed in the slots 82 and into the package assembly 20.

Referring again to FIG. 3, during assembly, the hang tabs 22 are created by folding the hang tab panels 70, 74 along fold lines 72, 76. The upper minor flaps 66 are folded 180 degrees at fold line 68 into the package assembly 20. The hang tabs 22 are inserted into the slots 82. The flanges 78 are folded at fold lines 80 to stay within the package assembly 20 along the upper panel 30 to align the hang tabs 22 within the slots 82. Then the lower minor flaps 62 are folded ninety degrees at fold lines 64 into the package assembly 20. Then the major flaps 50 are folded into the package assembly 20. The minor flaps 62, 66 provide additional structural support to the connection of the major flaps 50 to the front, top, back and bottom panels 28, 30, 34, 38.

Referring again to FIG. 3, the die layout for the blank 26 is arranged so that the hang tabs 22 can be incorporated into various positions on the top panel 30 by adapting the position of the fold line 72 to determine a location of the hang tabs 22 in both a lateral direction (horizontal arrow lines in FIGS. 1 and 2) and in a fore-aft direction (vertical arrow line in FIG. 2). With reference to FIGS. 1 and 2, the hang tabs 22 can be adjusted toward a lateral center of the package assembly 20, or toward lateral ends of the package assembly 20, depending on applicable loading of the housed consumer product. The lateral spacing of the hang tabs 22 may also be coordinated with conventional hang rail spacings, such as one-inch increments.

Referring now to FIG. 2, the hang tabs 22 can extend upward from any location upon the top panel 30. By aligning the hang tabs 22 with a center of the package assembly 20 and/or a center of gravity of the consumer product and the package assembly 20, the package assembly can hang straight from the hang tabs 22 without tilting or misalignment.

Referring again to FIG. 3, by aligning the hang tab panels 70, 74 laterally within an overall blank 26 width that includes the front panel 28, major flaps 50, and the assembly flaps 54, the hang tabs 22 can be incorporated into the blank 26 without increasing an overall size of the blank 26. By maintaining the blank 26 size, waste is minimized in stamping the blank 26.

With reference to FIGS. 3-5, the exposed surfaces of the hang tab panels 70, 74 are from an underside of the blank 26. This arrangement permits the hang tabs 22 to be a different color than the exposed panels 28, 30, 34, 38, 50 of the package assembly 20. Alternatively, the underside of the blank 26 can be decorated so that the hang tabs 22 match a decoration color or theme of the exposed panels 28, 30, 34, 38, 50 of the package assembly 20.

Referring again to FIG. 3, the package assembly 26 is illustrated with an optional opening 83 or cutout to provide a window in the package assembly 26 for visual access and or tactile access of the partially enclosed product by the consumer. Any number of optional cutouts 83 may be provided to provide access to various features of the enclosed or partially enclosed product.

Figure 6:
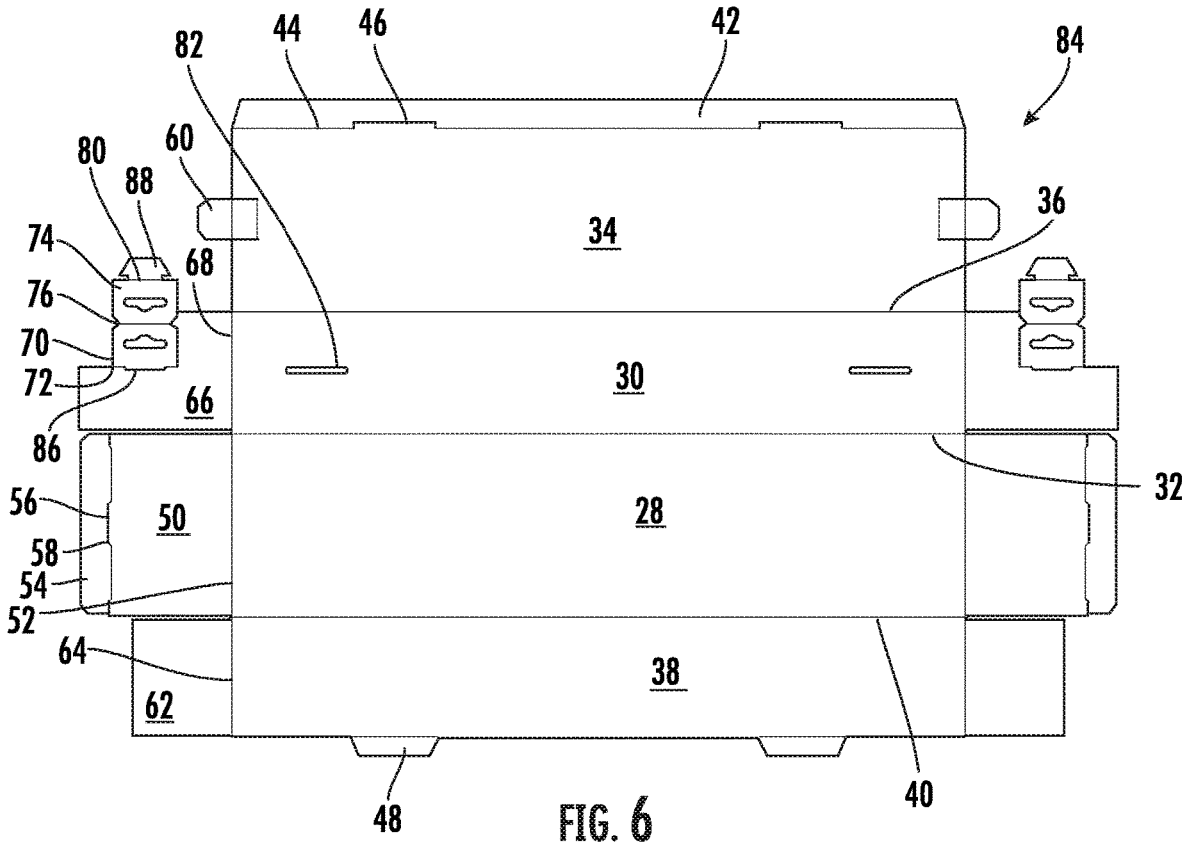
FIG. 6 is a plan view of a blank of the package assembly of FIG. 1, according to another embodiment.

FIG. 6 illustrates a blank 84 for the package assembly 20 according to another embodiment. Various panel dimensions may vary from the prior embodiment, depending upon the size and shape of the corresponding consumer product. A slot 86 is provided at the fold line 72 of the first hang tab panel 70 to the upper minor flap 66. Unlike the prior embodiment, the hang tab does not include a flange 78. Instead a locking tab 88 is connected to the second hang tab panel 74 at fold line 80. The locking tab 88 has an overall width greater than a width of the slot 86 to be inserted into the slot 86 and to lock the tab 88 within the slot 86, and to consequently lock the hang tab 22 relative to the top panel 30. The locking tab 88 has a tapered width increasing from a distal end toward the fold line 80 to assist in assertion of the locking tab 88 into the slot 86. The locking tab 88 also has a reduced width immediately adjacent the fold line 80 to permit the increased width of the locking tab 88 to pass into the slot 86.

In the depicted embodiment, the hang tabs 22 have an overall width that is greater than a width of the slots 82. This arrangement permits an interference fit of the hang tabs 22 within the slots 82. The first hang tab panel 70 has a tapered width increasing from the fold line 76 to the fold line 72. The second hang tab panel 74 also has a tapered width increasing from the fold line 76 to the fold line 80. When the second hang tab panel 74 is folded upon the first hang tab panel 70, the tapered widths align and guide the insertion of the hang tabs 22 into the slots 82.

The hang tabs 22 permit the hang tab 22 to have the same color and or decoration as the remainder of the package assembly 20 by permitting a rear surface of the first hang tab panel 70 and a rear surface of the second hang tab panel 74 to folded upon each other.

Figure 7:
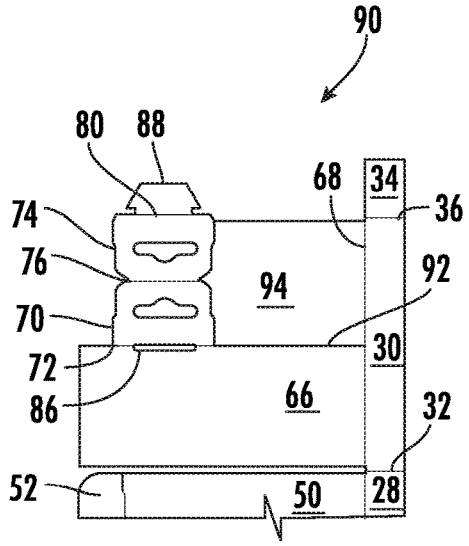
FIG. 7 is an enlarged view of a portion of a blank of the package assembly of FIG. 1, according to yet another embodiment.
Figure 8:
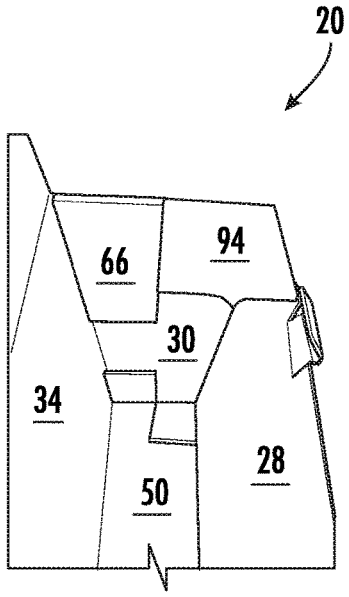
FIG. 8 is a side end perspective view of the package assembly of FIG. 7.

FIG. 7 illustrates a blank 90 for the package assembly 20 of FIG. 8 according to another embodiment. The blank 90 is similar to the prior embodiment. However, an additional cut line 92 is provided between the fold line 68 of the minor flap 66 and the top panel 30, and the fold line 72 of the first hang tab panel 70 and the minor flap 66, thereby creating a second minor flap 94. The first minor flap 66 is folded 180 degrees relative to the top panel 30 as illustrated in FIG. 8 for installation of the hang tabs 22. The second minor flap 94 provides a residual minor flap 94 to fold ninety degrees relative to the top panel 30. The second minor flap 94 acts as a dust flap 94 and assists with assembly of the major flap 50 in a standard tuck arrangement to strengthen the end of the assembled package assembly 20.

Figure 9:
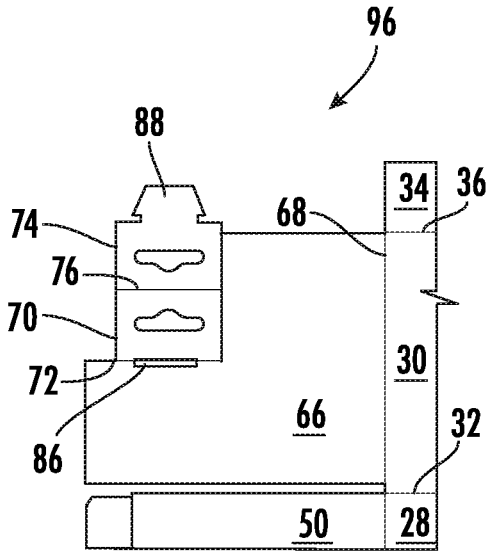
FIG. 9 is an enlarged view of a portion of a blank of the package assembly of FIG. 1, according to yet another embodiment.
Figure 10:
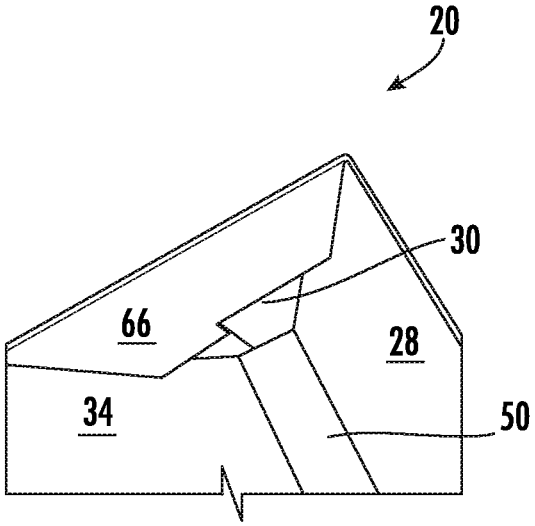
FIG. 10 is a side end perspective view of the package assembly of FIG. 9.

FIG. 9 illustrates a blank 96 for a package assembly 20 of FIG. 10 according to another embodiment. The blank 96 is similar to the blank 84 of the prior embodiment of FIG. 6. However, the first hang tab panel 70 and the second hang tab panel 74 are not tapered and have a consistent width for a loose connection within the slot 82 of the top panel 30.

Figure 11:
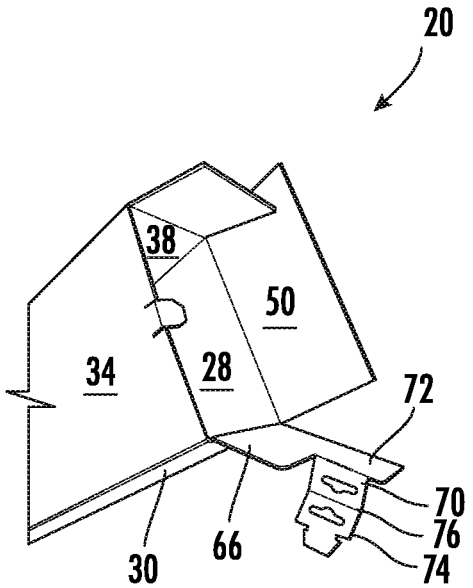
FIG. 11 is a side end perspective view of the package assembly of FIG. 9, illustrating an assembly step according to an embodiment.
Figure 12:
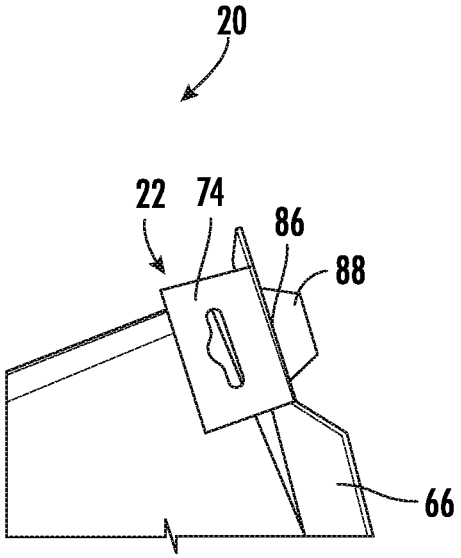
FIG. 12 is another side end perspective view of the package assembly of FIG. 9, illustrating another assembly step.
Figure 13:
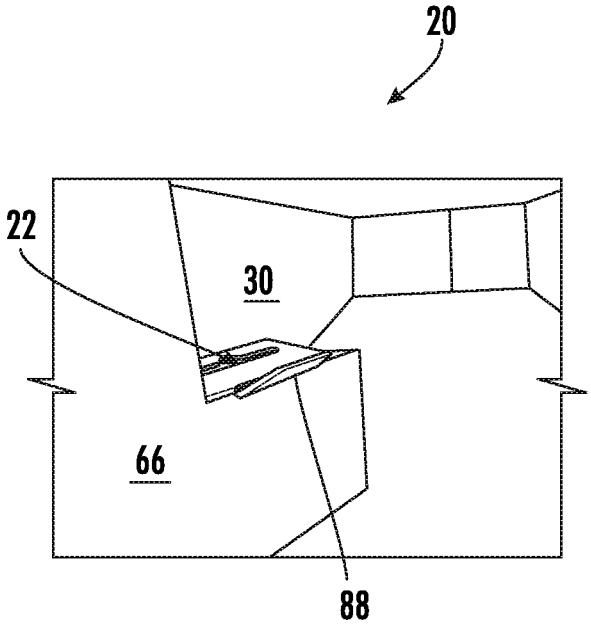
FIG. 13 is another side end perspective view of the package assembly of FIG. 9, illustrating another assembly step.
Figure 14:
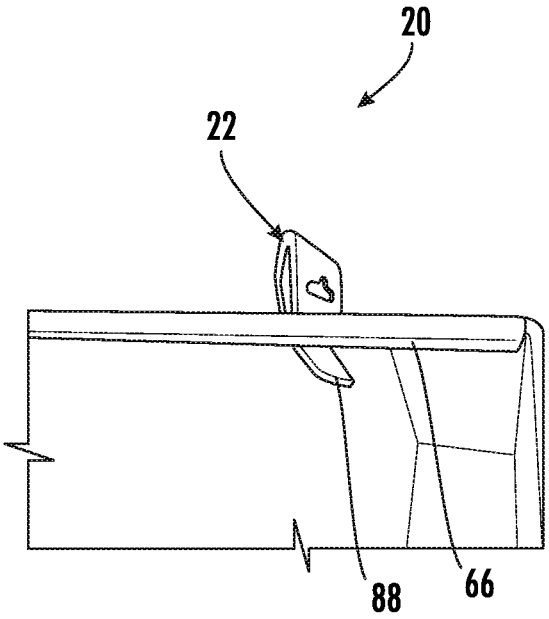
FIG. 14 is another side end perspective view of the package assembly of FIG. 9, illustrating another assembly step.

FIGS. 11-14 illustrate construction of the hang tabs 22 of the package assembly 20 of FIG. 10 from the blank 96 of FIG. 9. In FIG. 11, the first hang tab panel 70 is folded along the fold line 72 with the minor flap 66. Next, in FIG. 12, the second hang tab panel 74 is folded toward the first hang tab panel 70 along fold line 76 to create a rollover of the hang tab panels 70, 74. In FIG. 12, the locking tab 88 is inserted into the slot 86 to lock the hang tab 22. In FIG. 13, the minor flap 66 is pivoted toward the top panel 30. Then, in FIG. 14, the hang tab 22 is inserted through the slot 82 in the top panel 30. For locking embodiments, the hang tab 22 is locked in place in this position.

Figure 15:
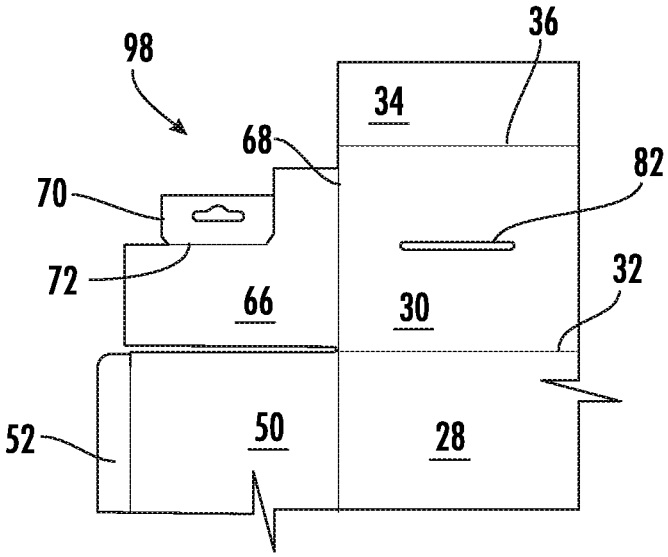
FIG. 15 is an enlarged view of a portion of a blank of the package assembly of FIG. 1, according to yet another embodiment.

FIG. 15 illustrates a blank 98 for a package assembly 20 of FIG. 1 according to another embodiment. The blank 98 is similar to the blanks 26, 84, 90 of the prior embodiments. However, the first hang tab panel 70 is a single hang tab panel 70 without a second hang tab panel. According to an embodiment, the first hang tab panel 70 does not include a flange nor a locking tab. The single hang tab panel 70 is folded to extend through the slot 82 in the top panel 30 for hanging the product package assembly 20.

Figure 16:
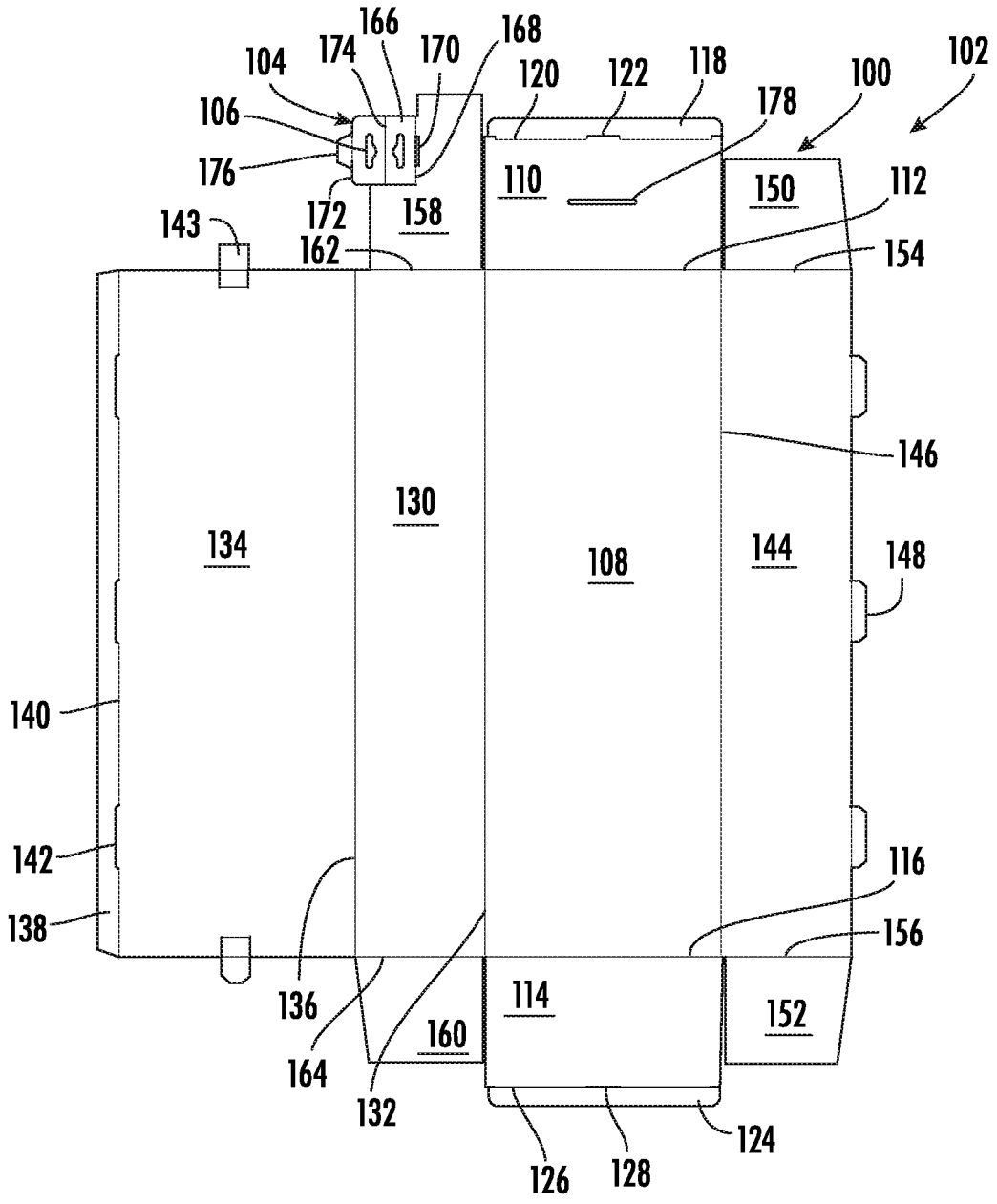
FIG. 16 is a plan view of a blank of a package assembly according to another embodiment.

FIG. 16 illustrates a blank 100 for a package assembly 102 according to another embodiment. Various panel dimensions may vary from the prior embodiment, depending upon the size and shape of the corresponding consumer product. The blank 100 includes a single hang tab 104. The package assembly 102 is folded to a closed box to be hung by the hang tab 104 when merchandised. The hang tab 104 includes a slot 106 to receive a peg of a pegboard, as is known in the art.

The blank includes a front panel 108 with a height and width to house the consumer product. A top panel 110 is pivotally connected to the front panel 108 at fold line 112. The top panel 110 has a depth and a width to house the consumer product. A bottom panel 114 is pivotally connected to the front panel 108 at fold line 116. For the present embodiment, the bottom panel 114 also has similar dimensions to the top panel 110. A top assembly flap 118 is provided along the top panel 110 along a fold line 120. A slot 122 is formed through the top-flap fold line 120. A bottom assembly flap 124 is provided along the bottom panel 114 along a fold line 126. A slot 128 is formed through the bottom-flap fold line 126.

A side panel 130 with a depth corresponding to the depth of the top and bottom panels 110, 114, and with a height corresponding to the height of the front panel 108 is pivotally connected to the front panel 108 at fold line 132. A rear panel 134 with dimensions similar to the front panel 108 is pivotally connected to the side panel 130 at fold line 136. A rear assembly flap 138 is pivotally connected to the rear panel 134 at fold line 140. A plurality of slots 142 are formed along the fold line 140. A pair of locking tabs 143 are provided along a top edge and a bottom edge of the rear panel 134. Another side panel 144 is pivotally connected to the front panel 108 along fold line 146. A plurality of locking tabs 148 are provided along a distal lengthwise edge of the side panel 144.

During assembly, the front panel 108, the side panels 130, 144, the rear panel 134, and the rear assembly flap 138 are folded along the fold lines 132, 136, 140, 146 so that the rear assembly flap 138 is received behind the side panel 144. The locking tabs 148 extend through the slots 142 to fasten the side panel 144 and the rear panel 134.

A pair of minor end panels 150, 152 are pivotally connected to the side panel 144 at fold lines 154, 156. Another pair of minor end panels 158, 160 are pivotally connected to the other side panel 130 at fold lines 162, 164. During assembly, the lower minor flaps 152, 160 are folded into the package assembly 102. Then, the bottom panel 114 is folded over the minor flaps 152, 160 and the assembly flap 124 is inserted into the package assembly 102 in contact within the rear panel 134. The lower locking tab 143 is inserted into the slot 128 to lock the bottom panel 114 to the back panel 134.

The hang tab 104 includes a first hang tab panel 166 pivotally connected to the top minor flap 158 at fold line 168. A slot 170 is formed in the fold line 168. A second hang tab panel 172 is pivotally connected to the first hang tab panel 166 at fold line 174. The slot 106 is formed through the first hang tab panel 166 and the second hang tab panel 172. A locking tab 176 is provided on the second hang tab panel 172. During assembly, the second hang tab panel 172 is folded upon the first hang tab panel 166 and the locking tab 176 is fastened into the slot 170.

During assembly, the top minor flap 150 is folded into the package assembly 102. Then, the minor flap 158 is folded into the package assembly 102 with the hang tab 104 extending upright. A slot 178 is provided in the top panel 110. The top panel 110 is folded over the minor flap 158 and the hang tab 104 is inserted into the slot 178 to extend through the top panel 110 and out of the package assembly 102. The top assembly flap 118 is folded inside the rear panel 134, and then the locking tab 143 is inserted into the slot 122 thereby locking the top panel 110 to the rear panel 134.

The top minor flaps 150, 158 can be any suitable length to overlap the top minor flaps 150, 158; to provide a gap between the top minor flaps 150, 158; or to permit the top minor flaps 150, 158 to coterminate.

Figure 17:
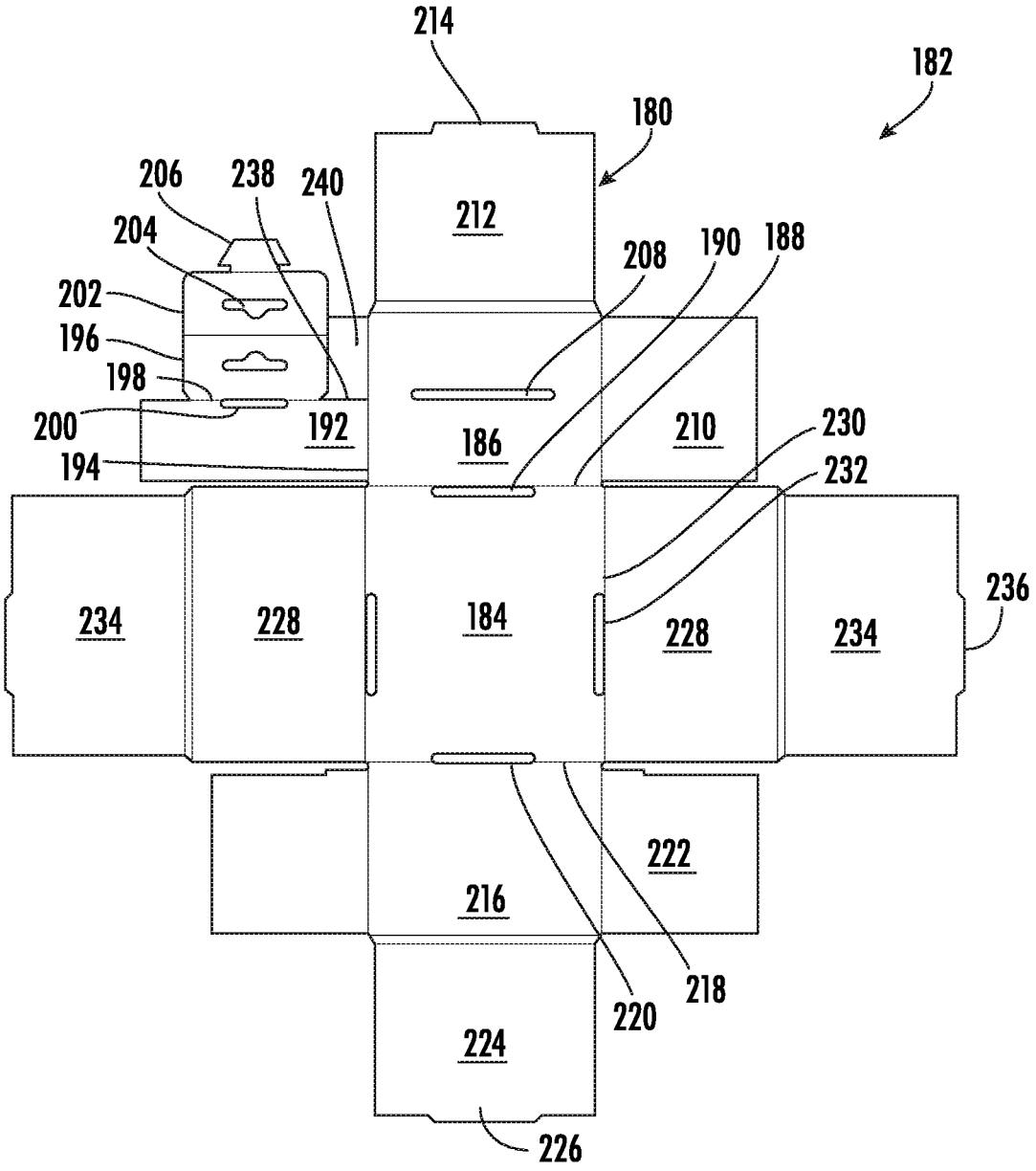
FIG. 17 is a plan view of a blank of a package assembly according to another embodiment.

FIG. 17 illustrates a blank 180 for a package assembly 182. The package assembly 182, once assembled includes an open front, such a tray package. The blank 180 includes a back panel 184. An outer top panel 186 is pivotally connected to the back panel 184 at a fold line 188. A slot 190 is formed in the fold line 188. A first minor flap panel 192 is pivotally connected to the outer top panel 186 at fold line 194. A first hang tab panel 196 is pivotally connected to the first minor flap panel 192 at fold line 198. A slot 200 is formed in the fold line 198. A second hang tab panel 202 is pivotally connected to the first hang tab panel 196. A slot 204 is formed through the hang tab panels 196, 202 to hang the package assembly 182 upon a peg at a point-of-sale display, if required. A locking tab 206 is provided upon the second hang tab panel 202. The second hang tab panel 202 is folded over the first hang tab panel 196 and the locking tab 206 is inserted into the slot 200 thereby the hang tab panels 196, 202 together.

A slot 208 is formed through the outer top panel 186. The first minor flap 192 is folded upon the outer top panel 186 and the hang tab panels 196, 202 are inserted through the slot 208 to extend out of the package assembly 182. A second minor flap 210 is pivotally connected to the outer top panel to be folded over the first minor flap 192. An inner top panel 212 is pivotally connected to the outer top flap 186 to pivot over the minor flaps 192, 210. A locking tab 214 extends from the inner top panel 212 to extend into the slot 190 to lock minor flaps 192, 210 between the top panels 186, 212 and to lock the inner top panel 212 to the back panel 184.

An outer bottom panel 216 is pivotally connected to the back panel 184 at fold line 218 with a slot 220 formed at the fold line 218. A pair of minor flaps 222 are pivotally connected to the outer bottom panel 216 to fold upon the outer bottom panel 216. An inner bottom panel 224 is pivotally connected to the outer bottom panel 216 to fold over the pair of minor flaps 222. A locking tab 226 is provided on the inner bottom panel 224 so that when the inner bottom panel is folded into the package assembly 180, the inner bottom panel 224 is locked to the back panel 184 by the locking tab 226 inserted into the slot 220.

A pair of outer side panels 228 are each pivotally connected to the back panel 184 at fold lines 230 with slots 232 formed at the fold lines 230. A pair of inner side panels 234 are each pivotally connected to one of the outer side panels 228. A locking tab 236 is provided on each inner side panel 234 so that when the inner side panel 234 is folded into the package assembly 180, the inner side panel 234 is locked to the back panel 184 by the locking tab 236 inserted into the slot 232.

According to another embodiment, the minor flaps 210, 222 could be folded within the outer side panels 228, and then locked by the inner side flaps 234 to interlock the top and bottom panels 186, 212, 216, 224 to the side panels 228, 234.

The minor flap 192 may be cut along cut line 238 to create a second minor flap 240. As the first minor flap 192 is pivoted 180 degrees to fit between the outer upper panel 186 and inner upper panel 212, the second minor flap 240 may be folded to ninety degrees. The second minor flap 240 may be received between the outer side panel 228 and the inner side panel 234 to interlock the top panel 186 with the side panels 228, 234.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A package assembly comprising:

a plurality of pivotally connected panels to collectively at least partially enclose a product; and at least one hang tab pivotally connected to a minor panel of the plurality of pivotally connected panels, to extend through a first slot in one of the plurality of pivotally connected panels to support the package assembly at retail; and wherein the at least one hang tab further comprises:

a first hang tab panel pivotally connected to the minor panel, wherein a second slot is formed at a fold line of the first hang tab panel and the minor panel, a second hang tab panel pivotally connected to the first hang tab panel, and a locking tab extending from the second hang tab panel to lock within the second slot at the fold line of the first hang tab panel and the minor panel.

2. The package assembly of claim 1 wherein the at least one hang tab is centered on the package assembly to lie in a plane with a center of gravity of the package assembly and the at least partially enclosed product.

3. The package assembly of claim 1 wherein the plurality of pivotally connected panels further comprises:

a front panel;

a top panel;

a rear panel; and a bottom panel; and wherein the minor panel is pivotally connected to one of the front panel, the top panel, the rear panel, and the bottom panel.

4. The package assembly of claim 3 wherein the minor panel is pivotally connected to the top panel.

5. The package assembly of claim 3 wherein the minor panel is further defined as a first minor panel pivotally connected to the top panel at a fold line; and wherein the package assembly further comprises a second minor panel pivotally connected to the top panel at the same fold line as the first minor panel, with a cut line separating the first minor panel and the second minor panel.

6. The package assembly of claim 3 wherein the first slot is formed through the top panel for the at least one hang tab to extend through the top panel.

7. The package assembly of claim 6 further comprising a flange pivotally connected to the at least one hang tab to extend into the package assembly and retain the at least one hang tab within the first slot.

8. The package assembly of claim 3 wherein the plurality of pivotally connected panels further comprises a pair of major end panels, each pivotally connected to a lateral end of one of the front panel, the top panel, the rear panel, and the bottom panel.

9. The package assembly of claim 8 wherein the pair of major end panels conceals the minor panel within the package assembly.

10. The package assembly of claim 8 wherein the minor panel covers a seam along one of the pair of major end panels.

11. The package assembly of claim 1 wherein the package assembly is formed from a unitary sheet of material, and the at least one hang tab is positioned laterally within an overall rectilinear area of the package assembly when flat to avoid an increase to an overall size of the sheet of material.

12. The package assembly of claim 1 wherein the at least one hang tab has a width greater than a width of the first slot to provide an interference fit within the first slot.

13. The package assembly of claim 1 wherein the at least one hang tab is provided with a slot to receive a peg at a point-of-sale display.

14. The package assembly of claim 1 wherein polymers and adhesives are omitted from the package assembly.

15. A method of arranging the at least one hang tab on the package assembly of claim 1, the method comprising:

providing the plurality of pivotally connected panels to collectively at least partially enclose and package the product;

determining at least one hang tab location to support the package assembly; and providing the at least one hang tab on the minor panel spaced from a pivotal connection of the minor panel to extend within the package to the determined hang tab location.

16. A method of assembling the package assembly of claim 1, the method comprising:

providing the plurality of pivotally connected panels to collectively at least partially enclose and package the product;

providing the at least one hang tab on the minor panel spaced from a pivotal connection of the minor panel to extend within the package;

folding the minor panel into the package; and inserting the at least one hang tab into the first slot in one of the plurality of pivotally connected panels.

17. The method of claim 16 further comprising pushing the at least one hang tab partially into the first slot for compactness during transit.

18. A package assembly comprising:

a plurality of pivotally connected panels to collectively at least partially enclose a product; and at least one hang tab pivotally connected to a minor panel of the plurality of pivotally connected panels, to extend through a slot in one of the plurality of pivotally connected panels to support the package assembly at retail;

wherein the plurality of pivotally connected panels further comprises:

a front panel, a top panel, a rear panel, and a bottom panel;

wherein the minor panel is pivotally connected to one of the front panel, the top panel, the rear panel, and the bottom panel;

wherein the minor panel is further defined as a first minor panel pivotally connected to the top panel at a fold line; and wherein the package assembly further comprises a second minor panel pivotally connected to the top panel at the same fold line as the first minor panel, with a cut line separating the first minor panel and the second minor panel.

* * * * *